United States Patent [19]

Cherry

[11] Patent Number: 4,742,751

[45] Date of Patent: May 10, 1988

[54] PERFORMER'S GUITAR STAND

[76] Inventor: Marc C. Cherry, 11421 Herefordshire Way, Germantown, Md. 20875

[21] Appl. No.: 33,355

[22] Filed: Apr. 2, 1987

[51] Int. Cl.[4] ..... G10G 5/00

[52] U.S. Cl. ..... 84/327; 84/421; 84/453

[58] Field of Search ..... 84/327, 421, 453

[56] References Cited

U.S. PATENT DOCUMENTS 2,547,924 4/1951 Citro ..... 84/327
4,037,815 7/1977 DeLano ..... 84/327 X
4,274,181 6/1981 Schaller ..... 84/327 X
4,691,610 9/1987 Gilbert ..... 84/327

*Primary Examiner*—Lawrence R. Franklin
*Attorney, Agent, or Firm*—Barnes & Thornburg

[57] ABSTRACT

An apparatus for holding a guitar in playing position is provided which connects to the strap fasteners attached to the guitar body. The apparatus includes a bracket for receiving the strap fasteners and supporting the instrument at the strap fasteners. The bracket is supported by a support part such that the instrument is held in a substantially horizontal playing position.

14 Claims, 1 Drawing Sheet

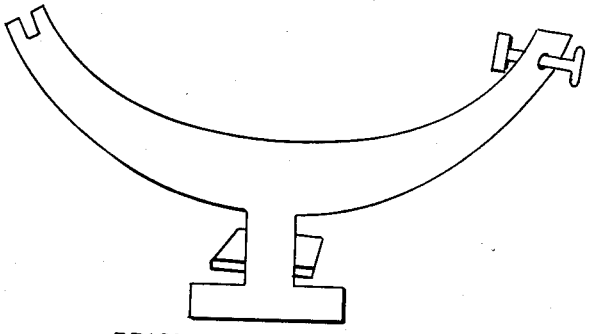
PRIOR ART
FIG. 1
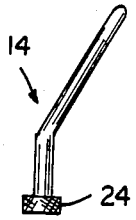
FIG. 6
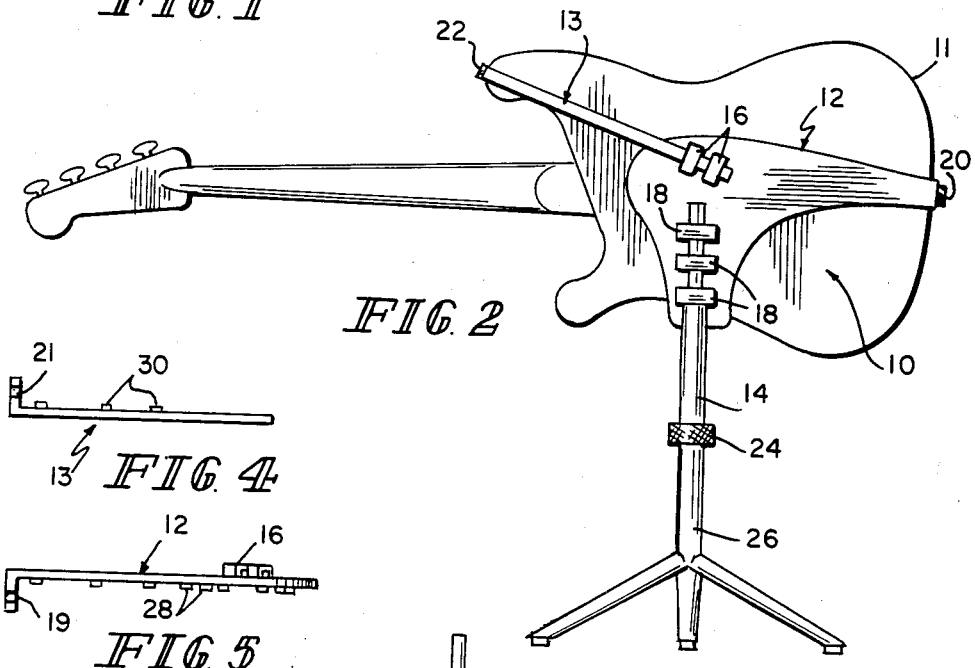
FIG. 2
FIG. 4
FIG. 5
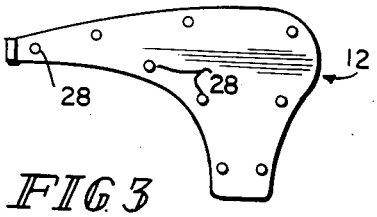
FIG. 3
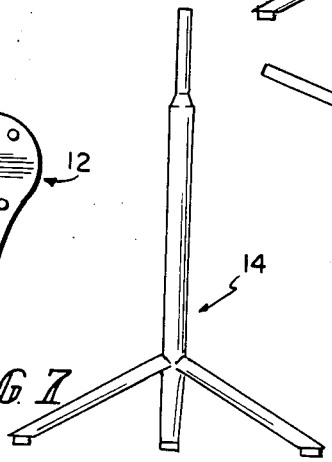
FIG. 7
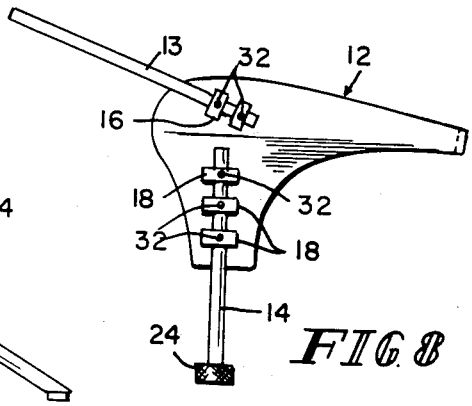
FIG. 8

PERFORMER'S GUITAR STAND

BACKGROUND AND SUMMARY OF THE INVENTION

The present invention relates to a stand for supporting a stringed musical instrument, in particular a guitar.

Stands for holding guitars usually are arranged so that the guitar is held in an upright, non-playing position. Although such stands are useful for temporarily holding a guitar, the upright position of the guitar makes it difficult, if not impossible, for a performer to play the guitar normally while it is being supported by the stand. Thus, in studio sessions, the performer would still have to remove the guitar from the stand and support it himself, either by a neck-strap or on the leg, while playing. This can create fatigue during long studio sessions.

A stand which is designed to hold an acoustic guitar with a round back in playing position is known to the Applicant, and seen in FIG. 1. As seen in this figure, the stand has semicircular arms which reach around the round back of the guitar. One arm has a slot cut into it to receive the neck of the guitar, while the other arm has a screw with a pressure plate that adjusts to clampingly hold the guitar in the stand. A bottom plate supports the guitar from underneath. Although this stand may be useful for acoustic guitars with round backs, its application to other types of guitars is severly limited.

Accordingly, an object of the present invention is to provide a stand which will support a stringed musical instrument such as a guitar in a substantially horizontal playing position which can be used with most standard guitars.

Another object of the present invention is to provide a stand which connects to the existing neck-strap knobs or fasteners already existent on most guitars for holding the neck-strap.

A further object of the invention is to provide a brace for holding a guitar which connects easily to a standard vertical stand.

A still further object of the present invention is to provide a bracket for holding the musical instrument which is quickly and easily removed from and/or mounted to the stand.

These and other objects are achieved according to the present invention in the provision of an apparatus for supporting, in a playing position, a stringed musical instrument having strap fasteners for receiving a body strap to hold said instrument. The apparatus includes a bracket for receiving the strap fasteners and supporting the instrument at the strap fasteners. The apparatus also includes support structure for supporting the bracket such that the instrument is in the playing position.

Some of the advantages provided by the present invention is the ability to use the apparatus to support most standard guitars. Another advantage is the arrangement of the apparatus that takes advantage of the neck-strap holders which are fitted on most guitars, in order to support the guitar. In this way, the finish of the guitar will not be marred by the apparatus, nor does any pressure need to be applied to the body of the guitar, possibly damaging or warping the guitar.

A further advantage provided by the present invention is the connectability of the apparatus to a standard vertical pole stand, thus allowing retrofitting of a stand with the apparatus of the present invention.

A still further advantage of the present invention is the easy removal from and mounting to the stand of the apparatus holding the guitar. This allows the performer to quickly take the guitar off the stand when desired, yet still be able to mount the guitar quickly and easily in order to play the guitar without having to support it himself.

Further objects, features, and advantages of the present invention will become more apparent from the following description when taken with the accompanying drawings, which show for purposes of illustration only, a preferred embodiment constructed in accordance with the present invention.

BRIEF DESCRIPTION OF THE DRAWINGS

FIG. 1 is a perspective view of a known guitar stand;

FIG. 2 is a front view of a preferred embodiment of the present invention holding a guitar in playing position;

FIG. 3 is a back view of the main bracket of the embodiment of the present invention according to FIG. 2;

FIG. 4 is a side view of the top brace of the embodiment of the present invention according to FIG. 2;

FIG. 5 is a side view of the main bracket of the embodiment of the present invention according to FIG. 2;

FIG. 6 is a side view of a preferred embodiment of the bottom brace of the present invention according to FIG. 2;

FIG. 7 is a schematic illustration of an alternate embodiment of the bottom brace of FIG. 2; and FIG. 8 is an alternate embodiment of the apparatus of the present invention.

DETAILED DESCRIPTION OF THE DRAWINGS

The known guitar stand shown in FIG. 1 was described in the Background and Summary of the Invention.

A front view of a preferred embodiment of the present invention is shown in FIG. 2. This corresponds to a view pointing in the direction of the back of the guitar 11. The apparatus, generally indicated with reference numeral 10, includes a main bracket 12 which is generally L-shaped or boomerang-shaped. A top brace 13 is connected to the main bracket 12. A top brace 13 is slidably received in metal sleeves 16 fastened to the front side of the main bracket 12, thus connecting the top brace 13 to the main bracket 12. A bottom brace 14 is connected to the downwardly extending arm of the main bracket 12 by sleeves 18 which slidably receive the bottom brace 14. At the end of the sleeve 14 is a coupling part 24 which, in a preferred embodiment, includes a socket for receiving the end of a pole of a vertical stand 26.

The main bracket 12 includes a slot 19, as best seen in the side view of the main bracket in FIG. 5, through which the neck-strap fastener knob 20 is received. Similarly, as seen in FIG. 4, the top brace 13 includes a slot 21 in its right angle leg for receiving the neck-strap fastening knob 22 which is permanently connected to the guitar. Thus, to fasten the guitar to the apparatus 10, the main bracket 12 is simply slid over the neck-strap fastener 20 while the top brace 13 is guided into sleeves 16 on the main bracket 12, so that slot 21 is slid over neck-strap fastening knob 22.

Although shown as slots 21, a number of arrangements for connecting the main bracket 12 and the top brace 13 to the neck strap fasteners 20, 22 are contemplated. Such arrangements include commercially available strap-locks, or sockets instead of slots 21.

The guitar is quickly and easily mounted to the stand 26 which has already been connected with the bottom brace 14. The guitar 11 will already have the main bracket 12 and the top brace 13 attached. By a simple lowering of the main bracket 12 so that the sleeves 18 fit over the bottom brace 14, the guitar 11 is mounted. Reversing the process removes the guitar 11.

The main bracket 12 is prevented from sliding all the way down the bottom brace 14 by a transverse widening of the bottom brace 14. Alternatively, or in addition, the bottom brace 14 and the top brace 13 can be secured to the sleeves 18 and 16 by screws 32, to provide a more secure connection, as seen in FIG. 8. In a contemplated embodiment, the bottom brace 14 has an extending pin on which sleeves 18 rest when the main bracket 12 is slid over the bottom brace 14.

The back view of the main bracket 12 is shown in FIG. 3, and illustrates a plurality of rubber tabs 28 attached to the back of the main bracket 12 so that the main bracket 12 will not mar the finish of the guitar 11. Similarly, as seen in FIG. 4, the top brace 13 also includes rubber tabs 30 which rest against the back of the guitar 11 when the guitar 11 is held by the apparatus 10.

A preferred embodiment of the bottom brace 14 of the present invention is shown in FIG. 6. In this embodiment, the bottom brace 14 is angled along its course. When the bottom brace 14 is received in sleeves 18 of the main bracket 12, the apparatus 10, and thus the guitar 11, will be held at an angle slightly deviating from perpendicular to the floor. In this position, the guitar 11 may be more easily played by the performer than when it is exactly perpendicular to the floor. Also, it provides a better balance for holding the guitar 11 to prevent tipping over the guitar 11 and apparatus 10.

An alternate preferred embodiment of the bottom brace 14 is shown schematically in FIG. 7. In this embodiment, the bottom brace 14 acts as the stand, so that a separate stand is not needed, as in the embodiment shown in FIG. 2.

Although the invention has been described in detail for use with a guitar, the apparatus may be used with other musical instruments, such as, for example, an electric bass, a banjo, or other instruments which have neck strap fastener knobs.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An apparatus for supporting a stringed musical instrument having strap fastening means for receiving and fastening a neck-strap to said instrument, said apparatus comprising:

bracket means for receiving said strap fastening means and supporting said instrument at said strap fastening means; and substantially rigid attachment means connected to said bracket means and adapted to be connected with support means for supporting said attachment means and said bracket means such that said instrument is in a substantially horizontal playing position.

2. The apparatus according to claim 1, wherein said attachment means includes connecting means for removably connecting said bracket means to a stand.

3. The apparatus according to claim 2, wherein said bracket means includes a bracket, having one arm of said bracket having first securing means for connecting to first said strap fastening means which is attached to a bottom of said instrument.

4. The apparatus according to claim 3, wherein said bracket means includes a top brace having one end attached to said bracket and another end attached by second securing means for connecting to said second strap fastening means attached to said instrument.

5. The apparatus of claim 4, wherein said first and second fastening means are slots in said bracket and said top brace having a diameter which allow said strap fastening means to pass through said slots.

6. The apparatus of claim 2, wherein said attachment means includes a bottom brace with a first end having stand connection means for connecting said bottom brace to said stand, and first sleeve means on said bracket part for receiving and holding a second end of said bottom brace.

7. The apparatus according to claim 6, wherein said bracket part includes second sleeve means for receiving and holding said second end of said top brace attached to said bracket part.

8. The apparatus of claim 6, wherein said bottom brace is angled along its course such that a median longitudinal plane of said guitar body is angled away from the vertical axis when said guitar is held in said playing position.

9. The apparatus of claim 1, wherein said support means includes a support stand, and said attachment means includes means for slidably receiving said support stand.

10. The apparatus of claim 1, wherein said support means includes a rigidly extending brace having stand connection means adapted to be connected to a stand for connecting said bracket means to said stand.

11. A stand for holding a guitar having neck-strap fastening means said steps comprising:

bracket means for receiving said strap fastening means and supporting said guitar at said strap fastening means;

support means for supporting said bracket means such that said guitar is in a substantially horizontal playing position; and vertical pole means for holding said bracket means and said support means.

12. An apparatus for supporting a musical instrument having strap fastening means for receiving and fastening a neck-strap to said instrument, said apparatus comprising:

bracket means for receiving said strap fastening means and supporting said instrument at said strap fastening means; and support means for supporting said bracket means such that said instrument is in a substantially horizontal playing position;

wherein said support means includes connecting means for removably connecting said bracket means to a stand; and wherein said support means includes a bottom brace with a first end having stand connection means for connecting said bottom brace to said stand, and first sleeve means on said bracket part for receiving and holding a second end of said bottom brace.

13. The apparatus according to claim 12, wherein said bracket part includes second sleeve means for receiving and holding said second end of said top brace attached to said bracket part.

14. The apparatus of claim 12, wherein said bottom brace is angled along its course such that a median longitudinal plane of said instrument is angled away from the vertical axis when said instrument is held in said playing position.

* * * * *